US006823845B2

(12) United States Patent
Schueler

(10) Patent No.: US 6,823,845 B2
(45) Date of Patent: Nov. 30, 2004

(54) FUEL INJECTION SYSTEM WITH IMPROVED REGULATION OF PUMPING QUANTITIES

(75) Inventor: Peter Schueler, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 31 days.

(21) Appl. No.: 10/279,858

(22) Filed: Oct. 25, 2002

(65) Prior Publication Data

US 2003/0089339 A1 May 15, 2003

(30) Foreign Application Priority Data

Oct. 27, 2001 (DE) ..... 101 53 185

(51) Int. Cl.[7] ..... F02M 37/00
(52) U.S. Cl. ..... 123/446; 123/495
(58) Field of Search ..... 123/446, 447, 123/495, 510, 511, 457, 458; 417/251, 252, 253, 298

(56) References Cited

U.S. PATENT DOCUMENTS 4,719,889 A * 1/1988 Amann et al. ..... 123/447
4,884,545 A * 12/1989 Mathis ..... 123/447
5,701,873 A * 12/1997 Schneider ..... 123/516
5,927,322 A * 7/1999 Rosenau ..... 123/447
6,162,022 A * 12/2000 Anderson et al. ..... 417/213
6,439,199 B2 * 8/2002 Ramseyer et al. ..... 123/446
6,615,806 B2 * 9/2003 Schueler ..... 123/514
6,647,965 B1 * 11/2003 Breeden ..... 123/446

* cited by examiner

*Primary Examiner*—Thomas N. Moulis
(74) *Attorney, Agent, or Firm*—Ronald E. Greigg

(57) ABSTRACT

A fuel system is disclosed in which high-pressure fuel pump with a prefeed pump is proposed, in which the fuel quantity pumped by the prefeed pump is distributed for cooling and lubrication purposes, via a continuously adjustable multiposition valve, to the pump elements of the high-pressure fuel pump or to the low-pressure region of the high-pressure fuel pump. The multiposition valve is controlled by the control unit of the engine. An advantageous feature of the high-pressure fuel pump of the invention is that depending on the operating state of the engine and of the high-pressure fuel pump, an optimal distribution of the fuel quantity pumped by the prefeed pump can always be accomplished. Moreover, the energy demand by the prefeed pump is reduced and its service life is lengthened.

17 Claims, 3 Drawing Sheets

FUEL INJECTION SYSTEM WITH IMPROVED REGULATION OF PUMPING QUANTITIES

BACKGROUND OF THE INVENTION

1. Field of the Invention

The invention relates to a fuel injection system for an internal combustion engine, having a control unit, having a high-pressure fuel pump with at least one pump element, and having a prefeed pump, wherein the prefeed pump pumps fuel from a tank to the intake side of the pump element or elements, and the fuel quantity pumped by the prefeed pump is carried to the pump element or elements or additionally to a low-pressure region of the high-pressure fuel pump.

2. Description of the Prior Art

A high-pressure fuel pump of the above type, known from German Patent Disclosure DE 196 53 339 A1, has a multiposition valve, which as a function of the pressure on the intake side of the high-pressure fuel pump distributes the fuel, pumped by the prefeed pump, to the low-pressure region of the high-pressure fuel pump or to the intake side of the pump elements. With this multiposition valve, there is a need to prevent resultant damage to the high-pressure fuel pump, such as might happen if because of a plugged fuel filter the pumping quantity of the prefeed pump should be inadequate. Through a throttle bore in the multiposition valve, the low-pressure region of the high-pressure fuel pump is in permanent communication with the intake side of the high-pressure fuel pump. The pumping capacity of the electric prefeed pump must therefore be dimensioned as relatively great. In this high-pressure fuel pump, no zero-feed throttle is provided. Instead, the pressure regulation is effected on the high-pressure side of the high-pressure fuel pump by means of a pressure limiting valve, which leads to poor overall efficiency of the fuel injection system.

OBJECT AND SUMMARY OF THE INVENTION

It is the object of the invention to furnish a fuel injection system whose operating behavior in most operating states is improved, whose construction is simplified, and which is adaptable in the simplest possible way to various internal combustion engines and prefeed pumps.

According to the invention, for a fuel injection system for an internal combustion engine, having a control unit, having a high-pressure fuel pump with at least one pump element, and having a prefeed pump, wherein the prefeed pump pumps fuel from a tank to the intake side of the pump element or elements, this object is attained in that the fuel quantity pumped by the prefeed pump is carried to the pump element or elements or additionally to a low-pressure region of the high-pressure fuel pump by a continuously variable multiposition valve, and that the multiposition valve is triggered by the control unit as a function of the operating state of the engine and/or of the fuel injection system.

By the use of a continuously adjustable multiposition valve, the pumping quantity regulation of the high-pressure fuel pump can be done more efficiently, since the fuel quantity aspirated by the high-pressure fuel pump is regulated, and the fuel that is at high pressure is not throttled for the sake of pressure regulation on the compression side of the high-pressure fuel pump. Moreover, by means of suitable triggering of the continuously adjustable multiposition valve, upon starting of the engine the entire pumping quantity of the prefeed pump can be carried to the pump elements, so that the pressure buildup on the compression side of the high-pressure fuel pump takes place as fast as possible, and thus the engine also starts as fast as possible. Moreover, by means of suitable triggering of the continuously adjustable multiposition valve, ventilation of the high-pressure fuel pump can be performed, should that be necessary. Furthermore, both the cooling and the lubrication of the high-pressure fuel pump can be effected by suitable triggering of the continuously adjustable multiposition valve in accordance with the operating states of the high-pressure fuel pump and/or of the engine, so that adequate lubrication and cooling of the high-pressure fuel pump is always assured.

In a variant of the high-pressure fuel pump employed in the system of the invention, it is provided that the multiposition valve is embodied as a single-stage three-way valve, with one inlet and with a first outlet and a second outlet; that the inlet of the multiposition valve is in communication with the compression side of the prefeed pump; that the first outlet of the multiposition valve is in communication with the intake side of the pump element or elements; and that the second outlet of the multiposition valve is in communication with the low-pressure region of the high-pressure fuel pump. In this variant, the advantages of the invention can be realized in a simple way. In particular, depending on the triggering of the multiposition valve, the entire pumping quantity of the prefeed pump can be carried to the pump elements; the low-pressure region of the high-pressure fuel pump can be ventilated, and both cooling and lubrication of the high-pressure fuel pump can be dimensioned to suit the need. Moreover, the prefeed pump must pump only counter to the requisite minimum pressure, so that the energy consumption of the prefeed pump is minimized and its service life is maximized.

In a further feature of the invention, the multiposition valve has a slide guided in a valve housing; in still another feature of the invention, it can be provided that the valve housing has a recess; that the inlet of the multiposition valve discharges into the recess; and that the slide, as a function of its position in the valve housing, uncovers the first outlet and the second outlet of the multiposition valve to a greater or lesser extent.

In a further feature of the invention, it can be provided that the multiposition valve uncovers the first outlet and blocks the second outlet, if there is no input signal at the multiposition valve, and/or that with an increasing input signal, the slide increasingly uncovers the second outlet and increasingly blocks the first outlet, so that in a simple way, the desired distribution of the fuel stream pumped by the prefeed pump can be accomplished to the pump elements and/or to the low-pressure region.

In another embodiment of the invention, a valve seat cooperating with the slide is embodied in the valve housing and is closed by the slide when the multiposition valve is fully triggered and thus disconnects the first outlet from the inlet, so that no further fuel reaches the pump elements. This valve position is advantageous above all in the overrunning mode of the engine. Because of the low pressures that act on the multiposition valve of the invention, this valve seat can seal off the first outlet reliably and without leakage, so that the pump elements do not aspirate any fuel, and thus a zero-feed throttle in the high-pressure region of the high-pressure fuel pump can be dispensed with. This further reduces the energy consumption of the prefeed pump and moreover further improves the starting performance of the engine.

To assure a minimum supply of fuel for lubrication and cooling purposes to the low-pressure region of the high-pressure fuel pump, it can be provided that a throttle is present between the first outlet and the second outlet. Alternative embodiments of the invention provide that the throttle is embodied as a bore in the slide or in the valve housing or is embodied by the play between the slide and the valve housing.

To further limit the power consumption of the prefeed pump, it is provided in a further feature of the invention that a pressure limiting valve is provided between the inlet and an intake side of the prefeed pump. This pressure limiting valve is advantageous above all whenever the prefeed pump is driven by the engine or the high-pressure fuel pump, and thus the pumping capacity rises virtually linearly with increasing engine rpm. The pressure limiting valve prevents the power demand of the prefeed pump from also rising in proportion to the engine rpm.

The object referred at the outset is also attained according to the invention by a method for generating and delivering fuel, which is at high pressure, in a fuel injection system, having a control unit, having at least one pump element, and having a prefeed pump, wherein the prefeed pump pumps fuel from a tank to the intake side of the pump element or elements, and the fuel quantity pumped by the prefeed pump is additionally carried by a multiposition valve to the pump element or elements or additionally to a low-pressure region of the high-pressure fuel pump, as a result of the provision that the pumping quantity of the prefeed pump is distributed, as a function of the operating state of the engine and/or of the fuel injection system, to the intake side of the pump element or elements and to the low-pressure region of the high-pressure fuel pump. With the method of the invention, the advantages of the invention discussed above can also be achieved.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
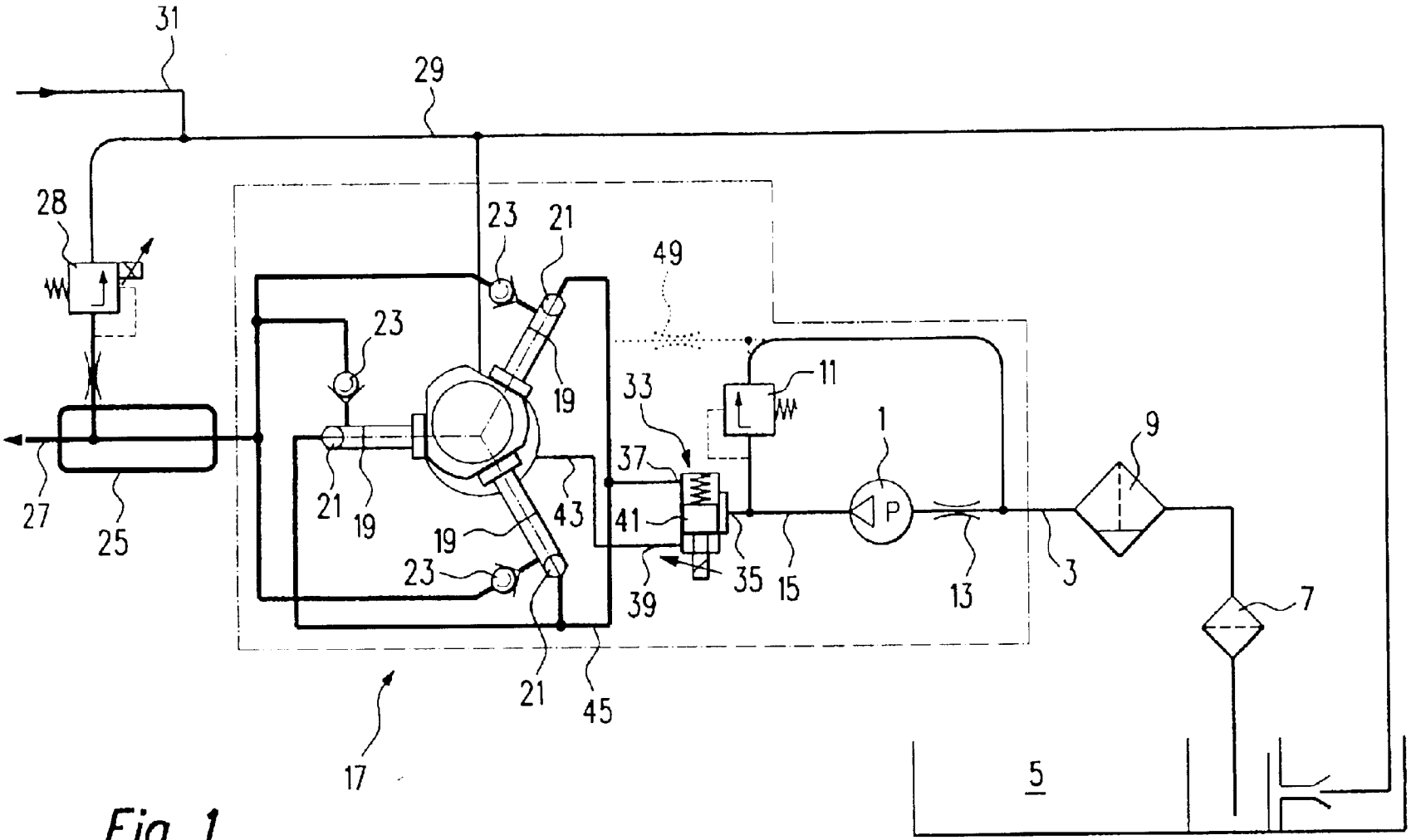
FIGS. 1 and 2 show exemplary embodiments of fuel injection systems of the invention.

In FIG. 1, one exemplary embodiment of a common rail injection system of the invention is shown schematically. A prefeed pump 1, via an inlet line 3, aspirates fuel, not shown, from a tank 5. The fuel is filtered in a prefilter 7 and in a filter with a water separator 9.

The prefeed pump 1 is embodied as a gear pump and has a first overpressure valve 11. On the intake side, the prefeed pump 1 is throttled by a first throttle 13. A compression side 15 of the prefeed pump 1 supplies fuel to a high-pressure fuel pump 17. The high-pressure fuel pump 17 is embodied as a radial piston pump with three pump elements 19, and it drives the prefeed pump 1. One intake valve 21 is provided on the intake side of each of the pump elements 19. One check valve 23 is provided on the compression side of each of the pump elements 19 and prevents the fuel, which is at high pressure and has been pumped into a common rail 25 by the pump elements 19, from being able to flow back into the pump elements 19.

The common rail 25 supplies one or more injectors, not shown in FIG. 1, with fuel, each via a respective high-pressure line 27. A pressure regulating valve 28, which connects the common rail to a return line 29 as needed, regulates the injection pressure of the injectors (not shown). Via the return line 29 and a leak fuel line 31, the leak fuel and the control quantities of the injector or injectors, not shown, are returned to the tank 5.

The high-pressure fuel pump 17 is supplied by the prefeed pump 1 on the one hand with fuel for the pump elements 19 and on the other with fuel for lubrication. The distribution of the fuel pumped by the prefeed pump 1 is done with the aid of a continuously adjustable multiposition valve 33. The layout and function of the multiposition valve 33 will be described in detail hereinafter in conjunction with FIGS. 3 and 4. The multiposition valve 33 has one inlet 35, which is in communication with the compression side 15 of the prefeed pump 1, and also has a first outlet 37 and a second outlet 39. A slide 41 of the multiposition valve 33 distributes the fuel quantity, pumped by the prefeed pump 1, to the first outlet 37 and the second outlet 39.

The fuel quantity that serves to lubricate the high-pressure fuel pump 17 is delivered to the high-pressure fuel pump 17 via the second outlet 39 and a line 43. Via a distribution line 45, the pump elements 19 are supplied with fuel from the first outlet 37 of the multiposition valve 33.

In the overrunning mode, that is, when a motor vehicle is driving downhill, for instance, no fuel should flow into the pump elements 19, and no fuel should be injected by the injectors, not shown, into the combustion chambers of the engine. Since under unfavorable conditions in this operating state, in some embodiments of the multiposition valve 33, fuel from the first outlet 37 of the multiposition valve 33 can reach the pump elements 19, a pressure would build up on the intake side of the pump elements 19, unless suitable precautions are taken, that would be so great that the pump elements 19 would open the intake valves 21 during the intake stroke and would aspirate fuel. The consequence would be that the pressure in the common rail 25 would rise impermissibly.

To prevent this, a second throttle 49 can be provided, which will hereinafter also be called a zero-feed throttle. By means of the zero-feed throttle 49, the fuel from the distribution line 45 can flow out into the low-pressure region of the fuel injection system. Because of the outflow of fuel through the zero-feed throttle 49, the aforementioned pressure buildup in the distribution line 45 in overrunning, from leakage from the multiposition valve 33 into the first outlet 37, is prevented.

Figure 2:
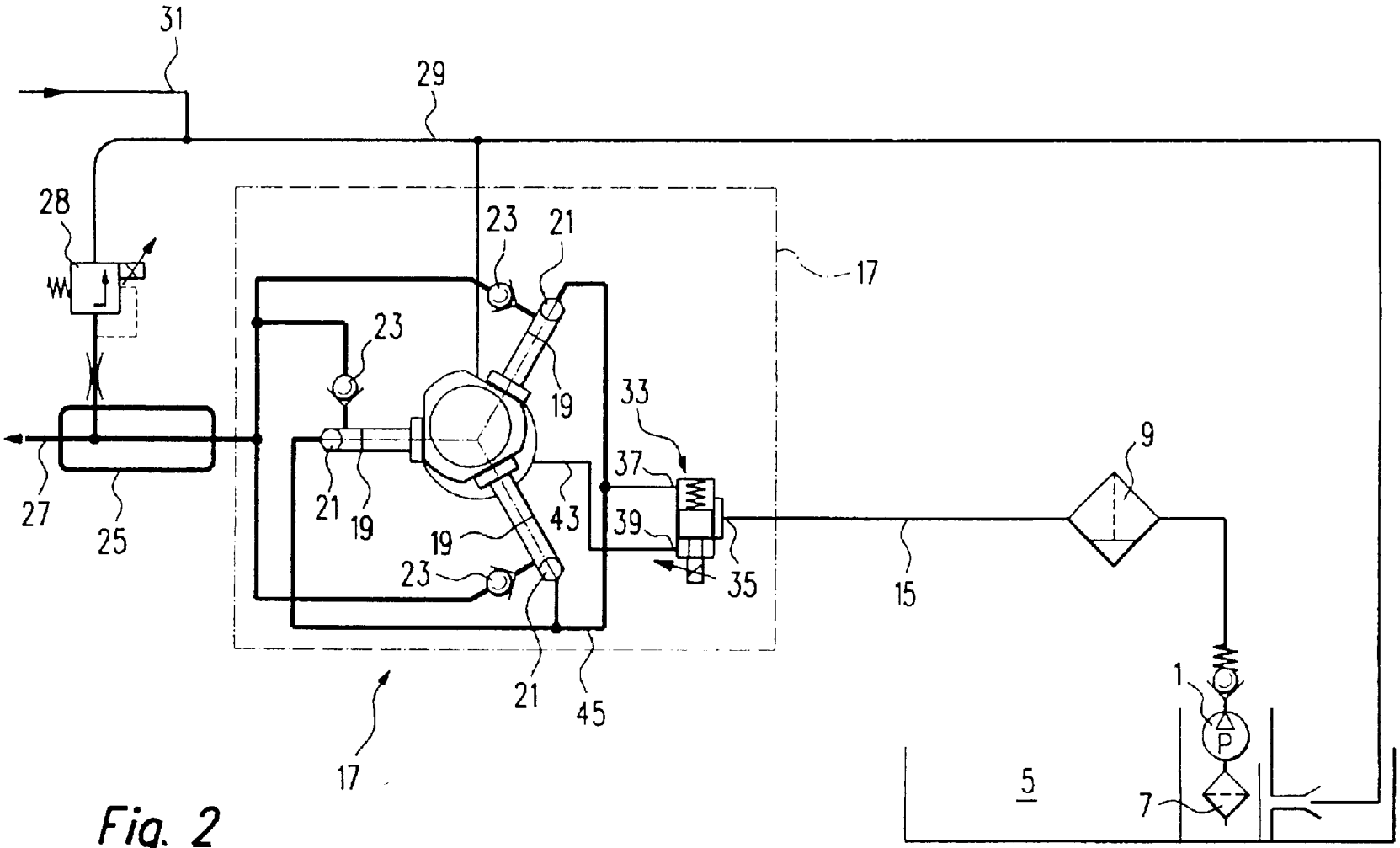

In FIG. 2, a second exemplary embodiment is shown schematically. In this exemplary embodiment, the prefeed pump is disposed in the tank 5 and is driven by electrical energy. Identical components have been provided with the same reference numerals as in FIG. 1, and what is said in conjunction with FIG. 1 applies accordingly. In the exemplary embodiment of FIG. 2, no zero-feed throttle is provided.

Figure 3:
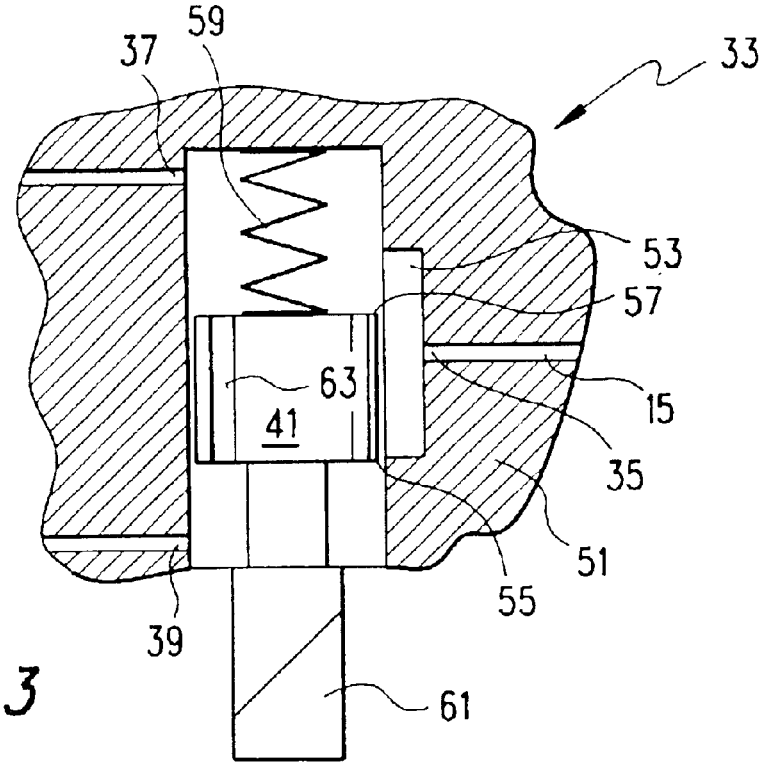
FIGS. 3 and 4 shows exemplary embodiments of continuously adjustable multiposition valves of the invention.

In FIG. 3, a first exemplary embodiment of a continuously adjustable multiposition valve 33 of the invention is shown. The slide 41 is guided in a valve housing 51. In the valve housing 51, a recess 53 is provided, into which the inlet 35 discharges. The inlet 35 is in communication with the compression side 15 of the prefeed pump 1 (not shown in FIG. 3). The slide 41 has a first control edge (55) and a second control edge (57), which cooperate with the recess 53. The slide 41 is adjusted via a compression spring 59 and an electromagnet 61. In the position shown in FIG. 3 for the slide 41, the first control edge 55 blocks the hydraulic communication between the recess 53, or inlet 35, and the second outlet 39 of the multiposition valve. This means that the entire fuel quantity pumped by the prefeed pump, not shown, flows via the inlet 35 and the recess 53 to the first outlet 37 and thus to the pump elements 19.

When current is supplied to the electromagnet 61, the slide 41 moves upward in FIG. 3, counter to the spring force of the compression spring 59. As soon as the first control edge 55 uncovers the recess 53, a divided flow of the fuel pumped by the prefeed pump, not shown, can flow into the second outlet 39. Depending on the position of the slide 41 relative to the recess 53, the ratio between the fuel quantity flowing into the first outlet 37 and that flowing into the second outlet 39 varies. As soon as the second control edge 57 has reached the upper end, in terms of FIG. 3, of the recess 53, the slide 41 blocks the communication between the inlet 35 and the first outlet 37.

Thus depending on the position of the slide 41 and as a function of the operating state of the engine or of the fuel injection system, an optimal distribution of the fuel quantity, pumped by the prefeed pump, to the pump elements or to the low-pressure region of the high-pressure fuel pump 17 can be accomplished. For example, if the best possible starting performance of the engine is considered especially important, then when the engine is put into operation all the fuel quantity pumped by the prefeed pump can be carried to the pump elements 19 (not shown). The result is a very fast pressure buildup on the high-pressure side of the high-pressure fuel pump.

If the high-pressure fuel pump is to be scavenged and cooled, for instance before a hot start of the engine, then the first outlet 37 can be blocked by the slide 41, so that the fuel quantity pumped by the prefeed pump, not shown, flows exclusively into the low-pressure region of the high-pressure fuel pump, where it cools the high-pressure fuel pump, carries vapor bubbles away, and lubricates the high-pressure fuel pump.

An especially advantageous aspect of the multiposition valve of the invention is that the prefeed pump automatically counteracts only the pressure, prevailing at the first outlet 37, on the intake side of the pump elements 19 (not shown), so that the energy demand of the prefeed pump is no greater than absolutely necessary. Excess fuel is pumped out via the second outlet 39. This lengthens the service life of the prefeed pump decisively. No additional overflow valve for controlling the inlet pressure to the element is necessary.

In the slide 41, a throttle 63 in the form of a bore in the slide 41 is provided. The throttle can take on the function of a zero-feed throttle 49 (see above in conjunction with FIG. 1). Through the throttle bore, it is also possible to ventilate the low-pressure loop, if the electromagnet 61 is switched to be without current. When the electromagnet 61 is fully supplied with current, that is, if the communication between the inlet 35 and the first outlet 37 is blocked, the throttle 63 acts as a zero-feed throttle. In all other operating states, the throttle 63 assures that a minimum cooling and lubricating quantity can always flow via the second outlet 39 into the low-pressure region of the high-pressure fuel pump 17, not shown. Alternatively, the throttle 63 can also be embodied by the play between the slide 41 and the valve housing 51. Alternatively, it is also conceivable to provide a bore (not shown) in the housing 51 that connects the first outlet 37 and the second outlet 39 with one another.

Figure 4:
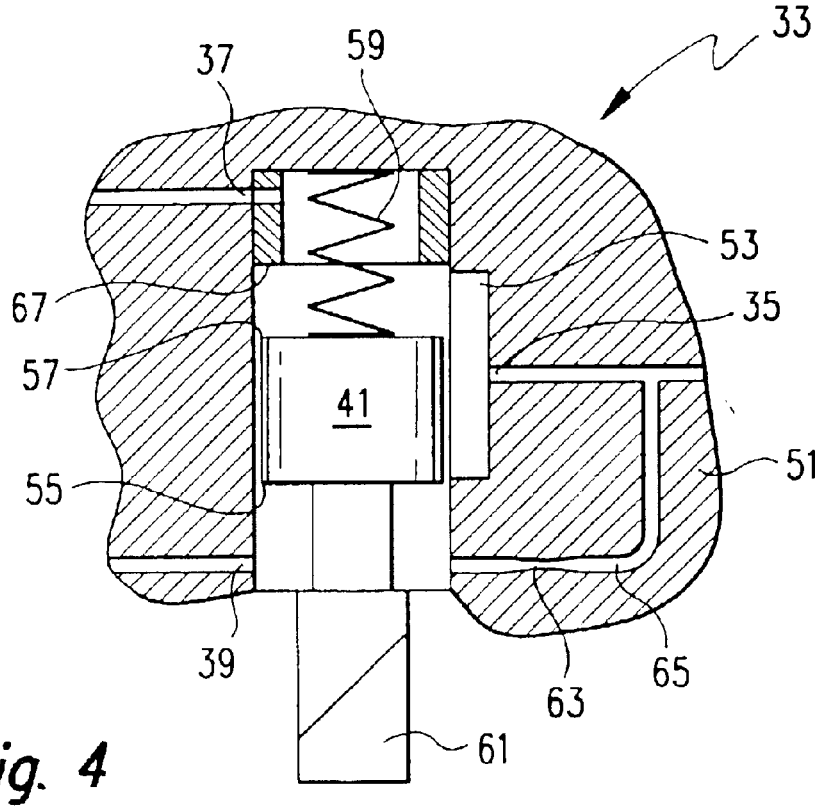

In FIG. 4, a second exemplary embodiment of a multiposition valve 33 of the invention is shown. In this exemplary embodiment, the throttle 63 is disposed in a bypass 65, which branches off from the inlet 35 and discharges into the part of the valve housing 51 at which the second outlet 39 originates. Given this interconnection of the throttle 63, it is assured that via the second outlet 39, the requisite minimum cooling and lubricating quantity of fluid can flow out, regardless of the position of the slide 41. In the upper region, in terms of FIG. 4, of the valve housing 51, a sealing seat 67 is provided. When full current is supplied to the electromagnet 61, the second control edge 57 of the slide 41 rests on the sealing seat 67 and seals off the inlet 35 from the first outlet 37 without leakage. The demand in terms of the sealing function of the sealing seat 67 is made easier by the pressure gradient, which in this position of the slide 41 is advantageously at a low level, since there is communication with the low-pressure region of the high-pressure fuel pump via the open second outlet 39, which by then is fully open. For this reason, no zero-feed throttle is needed in this exemplary embodiment.

The foregoing relates to preferred exemplary embodiments of the invention, it being understood that other variants and embodiments thereof are possible within the spirit and scope of the invention, the latter being defined by the appended claims.

I claim:

1. A fuel injection system for an internal combustion engine, comprising a control unit, a high-pressure fuel pump with a low pressure region and at least one pump element (19), a prefeed pump (1) for pumping fuel from a tank (5) to an intake side of the pump element or elements (19) or additionally to the low-pressure region of the high-pressure fuel pump (17), and a multiposition valve (33) embodied as a continuously adjustable multiposition valve (33);

the multiposition valve (33) being triggered by the control unit as a function of an operating state of the engine and/or of the fuel injection system, wherein the multiposition valve (33) comprises a single-stage three-way valve, with one inlet (35) and with a first outlet (37) and a second outlet (39); wherein the inlet (35) of the multiposition valve (33) is in communication with a compression side (15) of the prefeed pump (1); wherein the first outlet (37) of the multiposition valve (33) is in communication with the intake side of the pump element or elements (19); and wherein the second outlet (39) of the multiposition valve (33) is in communication with the low-pressure region of the high-pressure fuel pump (17).

2. The fuel injection system according to claim 1 wherein the multiposition valve (33) has a slide (41) guided in a valve housing (51).

3. The fuel injection system according to claim 2, wherein the valve housing (51) has a recess (53); wherein the inlet (35) of the multiposition valve (33) discharges into the recess (53); and wherein the slide (41), as a function of its position in the valve housing (51), uncovers the first outlet (37) and the second outlet (39) of the multiposition valve (33) to a greater or lesser extent.

4. The fuel injection system according to claim 1 wherein the multiposition valve (33) uncovers the first outlet (37) and blocks the second outlet (39), if there is no input signal at the multiposition valve (33).

5. The fuel injection system according to claim 2 wherein, with an increasing input signal, the slide (41) increasingly uncovers the second outlet (39) and increasingly blocks the first outlet (37).

6. The fuel injection system according to claim 2 wherein the valve housing (51) comprises a sealing seat (67) that cooperates with the slide (41); and wherein when the multiposition valve (33) is fully triggered, the slide (41) rests on the sealing seat (67) and disconnects the first outlet (37) from the inlet (35).

7. The fuel injection system according to claim 2 further comprising a throttle (63) between the first outlet (37) and the second outlet (39).

8. The fuel injection system according to claim 7 wherein the throttle (63) is embodied as a bore in the slide (41).

9. The fuel injection system according to claim 7 wherein the throttle (63) is embodied as a bore in the valve housing (51).

10. The fuel injection system according to claim 7 wherein the throttle (63) comprises the play between the slide (41) and the valve housing (51).

11. The fuel injection system according to claim 1 further comprising a pressure limiting valve (11) connected between the inlet (35) and an intake side of the prefeed pump (1).

12. The fuel injection system according to claim 1 further comprising a throttle (63) between the compression side (15) of the prefeed pump (1) and the second outlet (39) of the multiposition valve (33).

13. The fuel injection system according to claim 1 wherein the prefeed pump (1) is driven by an electric drive mechanism, by the engine, or by the high-pressure fuel pump (17).

14. A method for generating and delivering fuel, which is at high pressure, in a fuel injection system having a control unit, at least one pump element (19), and a prefeed pump (1), wherein the prefeed pump (1) pumps fuel from a tank (5) to the intake side of the pump element or elements (19), and the fuel quantity pumped by the prefeed pump (1) is additionally carried by a multiposition valve (33) to the pump element or elements (19) or additionally to a low-pressure region of the high-pressure fuel pump (17), the method comprising distributing the pumping quantity of the prefeed pump (1), as a function of the operating state of the engine and/or of the fuel injection system, to the intake side of the pump element or elements (19) and to the low-pressure region of the high-pressure fuel pump.

15. A control unit for a fuel injection system operable for performing the method of claim 14.

16. A computer program operable for performing the method of claim 14.

17. The computer program of claim 16 that is storable in memory in a storage medium.

* * * * *